US006390877B2

(12) United States Patent
Kim et al.

(10) Patent No.: US 6,390,877 B2
(45) Date of Patent: May 21, 2002

(54) METHOD FOR MANUFACTURING AN ELECTRON GUN INCLUDING A METAL LAYER BETWEEN A BASE METAL AND AN ELECTRON EMITTING LAYER

(75) Inventors: Yoon-Chang Kim; Jong-Seo Choi; Gyu-Nam Joo, all of Kyonggi-do (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/877,054

(22) Filed: Jun. 11, 2001

Related U.S. Application Data

(62) Division of application No. 09/305,387, filed on May 5, 1999, now abandoned.

(30) Foreign Application Priority Data

Dec. 8, 1998 (KR) ..... 98-53709

(51) Int. Cl.[7] ..... H01J 9/04
(52) U.S. Cl. ..... 445/51; 313/346 R
(58) Field of Search ..... 445/51; 313/346 R, 313/346 DC

(56) References Cited

U.S. PATENT DOCUMENTS 6,054,800 A * 4/2000 Joo et al. ..... 313/346 R
6,124,666 A * 9/2000 Saito et al. ..... 313/346 R
6,140,753 A * 10/2000 Joo et al. ..... 313/346 R
6,255,764 B1 * 7/2001 Choi et al. ..... 313/346 R

* cited by examiner

*Primary Examiner*—Kenneth J. Ramsey
(74) *Attorney, Agent, or Firm*—Robert E. Bushnell, Esq.

(57) ABSTRACT

The present invention relates to a cathode for an electron gun for increasing its life cycle under a high current density load by ensuring a diffusion path of reducing component served for generating free radical barium. The present invention discloses a cathode for an electron gun comprising a base metal composed of nickel and at least one kind of reducing component, an upper metal layer formed by spraying powder to the surface of the base metal, implanting Ni thereto, or grinding the surface thereof and heating it, and an electron emitting layer containing alkaline earth metal oxide including at least barium on the upper metal layer.

6 Claims, 6 Drawing Sheets

METHOD FOR MANUFACTURING AN ELECTRON GUN INCLUDING A METAL LAYER BETWEEN A BASE METAL AND AN ELECTRON EMITTING LAYER

This application is a division of U.S. patent application Ser. No. 09/305,387 filed on May 5, 1999 and now abandoned. This related application is relied on and incorporated herein by references in its entirety.

BACKGROUND OF THE INVENTION

1. Field of the Invention

The present invention relates to a cathode for an electron gun used in a cathode ray tube, and more particularly, to a cathode for an electron gun for increasing its life cycle under a high current density load by ensuring a steady diffusion path of reducing component served for generating free radical barium.

2. Description of the Prior Art

A cathode ray tube is a device for forming an image by excitation light emission of a fluorescent material of a screen by landing an electron emitted from an electron gun and accelerated by high voltage on the fluorescent material.

FIG. 5 is a general structural diagram of a cathode for an electron gun in a cathode ray tube.

In FIG. 5 the cathode comprises a heater 4 in a sleeve 2, a cap-formed base metal 6 composed of nickel Ni as a main component and a small amount of reducing component such as silicon Si and magnesium Mg on the upper side of sleeve 2, and an electron emitting layer 8 mainly composed of alkaline earth metal oxide containing at least barium on the cap-formed base metal 6.

In such a cathode, the metal oxide and the reducing component react to each other by heat from the heater to generate free radical barium, and thereafter thermion is emitted by using free radical barium.

An electron emission capacity of the cathode for the electron gun is depended on a supply amount of free radical barium contained in the metal oxide.

However, since the cathode ray tube has a tendency of high brightness and long-life cycle recently, a cathode which can supply free radical barium for a long time in high current density is required.

A cathode restraining free radical barium from evaporating by adding both of lanthanum La compound and magnesium compound Mg or La—Mg mixed compound to the electron emitting material layer containing alkaline earth metal oxide is disclosed.

However, in the conventional cathode, an intermediate layer 10 is generated in a boundary between the base metal 6 and electron emitting layer 8 by reaction as shown in FIG. 6, and it results to shorten the life of the cathode under high current density load of 2~3 A/cm$^2$.

The intermediate layer 10 is generated by reaction of barium oxide pyrolized from barium carbonate and silicon or magnesium.

$$BaO+Mg \rightarrow MgO+Ba\uparrow \quad \text{[Reaction formula 1]}$$

$$4BaO+Si \rightarrow Ba_2SiO_4+2Ba\uparrow \quad \text{[Reaction formula 2]}$$

Free radical barium generated by the reaction formula 1 or 2 is served to emit electron, however, MgO or $Ba_2SiO_4$ is additionally generated by the same reaction formulas to generate the intermediate layer 10 in the boundary between the base metal 6 and the electron emitting layer 8.

Such an intermediate layer 10 interferes the reaction for generating free radical barium requiring the reducing component by obstructing diffusion of the reducing component contained in the base metal 6, to shorten the life of the cathode. In addition, since the intermediate layer 10 has a high resistance, it limits the current density possible to emit the electron by interfering flow of the electron emitting current.

In another aspect, a cathode for an electron gun comprising a metal layer mainly composed of tungsten of which the reducing degree is same as or smaller than silicon or magnesium and larger than nickel between the base metal and the electron emitting material layer, and the electron emitting layer containing rare earth metal oxide to decompose the compound generated from the reaction, and thereby enabling the reducing component in the metal layer to serve to generate free radical barium is disclosed in Japanese patent laid-open No. 91-257735.

However, the cathode described above is stable at the beginning but its life cycle is suddenly deteriorated with the lapse of time since the additional reaction compound is generated when free radical barium is generated.

SUMMARY OF THE INVENTION

Accordingly, the present invention is directed to a cathode for an electron gun that substantially obviates one or more of the problems due to limitations and disadvantages of the related art.

An object of the present invention is to provide a cathode for an electron gun for increasing its life cycle under a high current density load by ensuring a diffusion path of reducing component of a base metal served for good generation of free radical barium, and dispersing formation of an intermediate layer To achieve the above objective, the present invention provides a cathode for an electron gun comprising:

a base metal composed of nickel and at least one kind of reducing component;

an upper metal layer formed by finely graining and heating the upper surface of the base metal; and an electron emitting layer containing alkaline earth metal oxide including at least barium on the upper metal layer.

The upper metal layer of the present invention is formed by accelerating powder of metal oxide composing the electron emitting layer to be collided against the upper surface of the base metal, implanting Ni atom to the surface of the base metal, or grinding the surface thereof and heating it in a hydrogenous condition to have particle smaller than that of the base metal.

Further, the electron emitting material layer according to the present invention can further contain both of lanthanum compound and magnesium compound or lanthanum-magnesium mixed compound in alkaline earth metal oxide containing at least barium.

According to the present invention, since the upper metal layer having particle smaller than that of the base metal effectively disperses the material generated by the reaction of BaO and Si or Mg, i.e. the intermediate layer and ensures a diffusion path of the reducing component steadily to prevent the generation of the intermediate layer having high resistance, the reaction for generating free radical barium requiring the reducing element can be continued to increase life cycle of the cathode under high current density load of 2~3 A/cm$^2$.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this specification, illustrate embodiments of the present invention and together with the description serve to explain the principles of the present invention.

In the drawings.

DETAILED DESCRIPTION OF THE PREFERRED EMBODIMENTS

Figure 1:
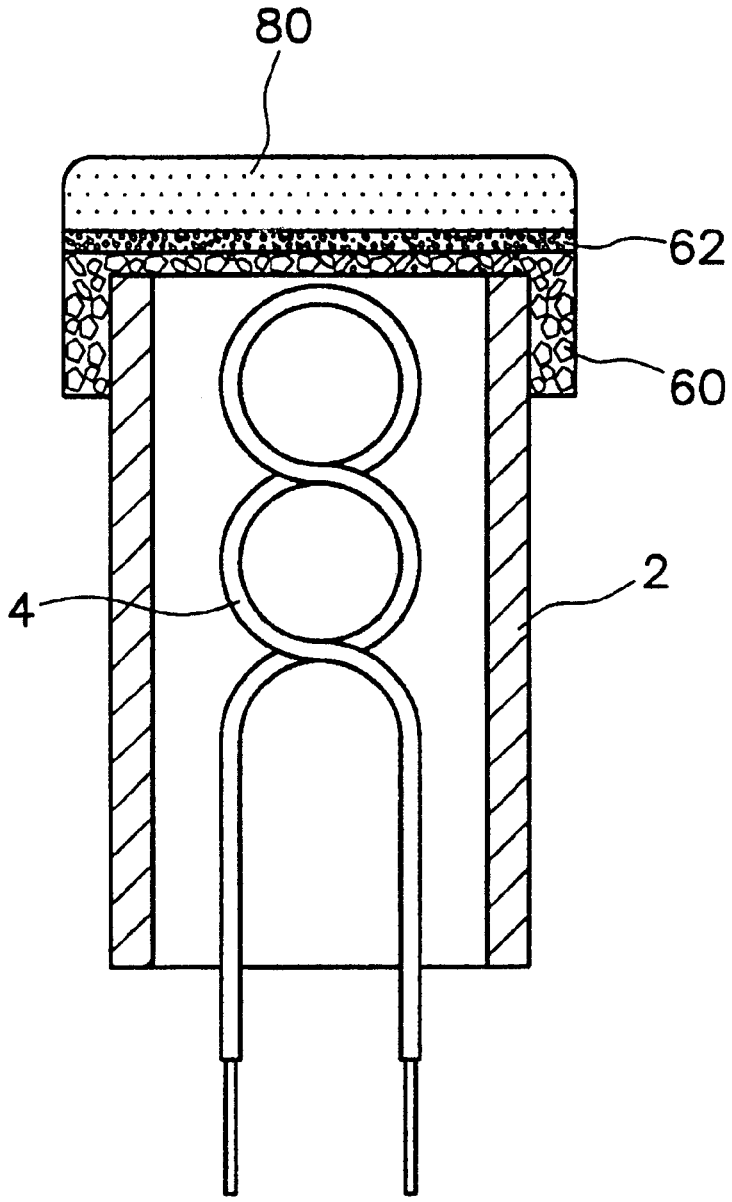
FIG. 1 is a sectional view of a cathode for an electron gun in accordance with the present invention.

Reference will now be made in detail to the preferred embodiments of the present invention, examples of which are illustrated in the accompanying drawings. Like reference numerals denote like reference parts throughout the specification and drawings.

Embodiment 1

As shown in FIG. 1, a cathode for an electron gun according to a first embodiment of the present invention comprises a cap-formed base metal 60 composed of Ni as a main component and a small amount of reducing component such as Si and Mg on upper opening portion of a sleeve 2 in which a heater 4 is mounted.

The cathode for the electron gun further comprises an upper metal layer 62 and an electron emitting layer 80 composed of alkaline earth metal oxide such as ternary carbonate (Ba Sr Ca)$CO_3$ or binary carbonate (Ba Sr)$CO_3$ containing at least Ba on the upper metal layer.

In the present embodiment, to disperse the material generated from the reaction of BaO and Si or Mg and accumulated in the boundary between the base metal 60 and the electron emitting layer 80 and to ensure a diffusion path of reducing component, the upper metal layer 62 is composed of fine-grain on the upper surface of the base metal 60.

Figure 2:
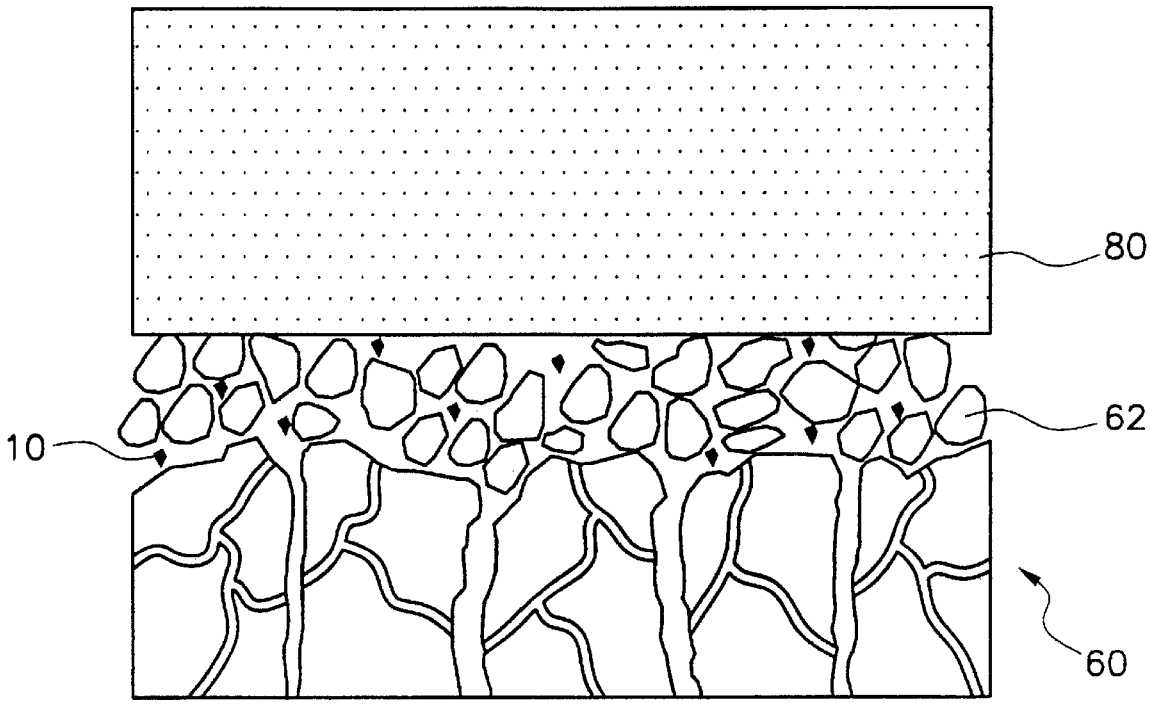
FIG. 2 is an enlarged sectional view of a main part of a cathode for an electron gun in accordance with the present invention.

Since the upper metal layer 62 according to the present embodiment is formed of particles smaller than those of the base metal 60 on the surface of the base metal 60 as shown in FIG. 2, the diffusion path of the reducing component contained in the base metal 60 is dispersed.

Therefore, the reaction of BaO and Si or Mg is performed in many areas of the fine-grain of the upper metal layer 62, the intermediate layer 10 is restrained from being accumulated. And the reducing component such as Si and Mg is smoothly diffused to be served to generate free radical barium.

The upper metal layer 62 is obtained by treating the surface of the base metal 60 in condition residual stress to exist, i.e. mechanical damage condition and heating it to be recrystallized.

In concrete, the upper metal layer 62 is formed by accelerating powder of metal oxide such as ternary carbonate or binary carbonate composing the electron emitting layer 80 to be collided to the upper surface of the base metal 60 to generate the residual stress and heating it in the temperature of 700~1,200° C. in a hydrogenous condition to form fine-grain by recrystallizaion.

In another aspect, the residual stress can be generated by implanting Ni atom to the surface of the base metal 60 or grinding the surface thereof.

At this point, the heating of the upper metal layer 62 can be performed by two steps in different temperature, and the fine-graining can effectively be realized by controlling the temperature of the first step to be lower than that of the second step.

The electron emitting layer 80 of ternary carbonate or binary carbonate is formed on the upper metal layer 62 to the thickness of 20~100 $\mu$m by spray. At this point, the thickness of the entire cathode must not exceed 300 $\mu$m.

Embodiment 2

The present embodiment proposes a cathode for an electron gun comprising a electron emitting layer composed of both of lanthanum compound and magnesium compound or lanthanum-magnesium mixed compound added to alkaline earth metal oxide.

The structure of the cathode according to the present embodiment is described below with reference to FIG. 1.

As shown in FIG. 1, a cathode for an electron gun according to the present embodiment comprises a cap-formed base metal 60 composed of Ni and a small amount of reducing component such as Si and Mg and an upper metal layer 62 formed on the surface of the base metal 60.

The cathode for the electron gun further comprises an electron emitting layer 80 composed of both of lanthanum compound and magnesium compound or lanthanum-magnesium mixed compound added to alkaline earth metal oxide such as ternary carbonate (Ba Sr Ca)$CO_3$ or binary carbonate (Ba Sr)$CO_3$ containing at least barium.

The La compound and Mg compound or La—Mg mixed compound restrains evaporation of free radical Ba to be continuously supplied. The content of the La compound and Mg compound or La—Mg mixed compound is preferably 0.01~1 wt% of the carbonate.

When the content thereof is less than 0.01 wt%, the evaporation of free radical Ba can not be effectively restrained and when the content thereof is more than 1 wt%, the electron emitting capacity at the beginning can be deteriorated.

According to the present embodiment, the intermediate layer 10 is effectively dispersed by the upper metal layer 62 and the evaporation of free radical Ba generated from the reaction of BaO and Si or Mg is restrained by the electron emitting layer l4 to prevent loss of the metal oxide.

Figure 3:
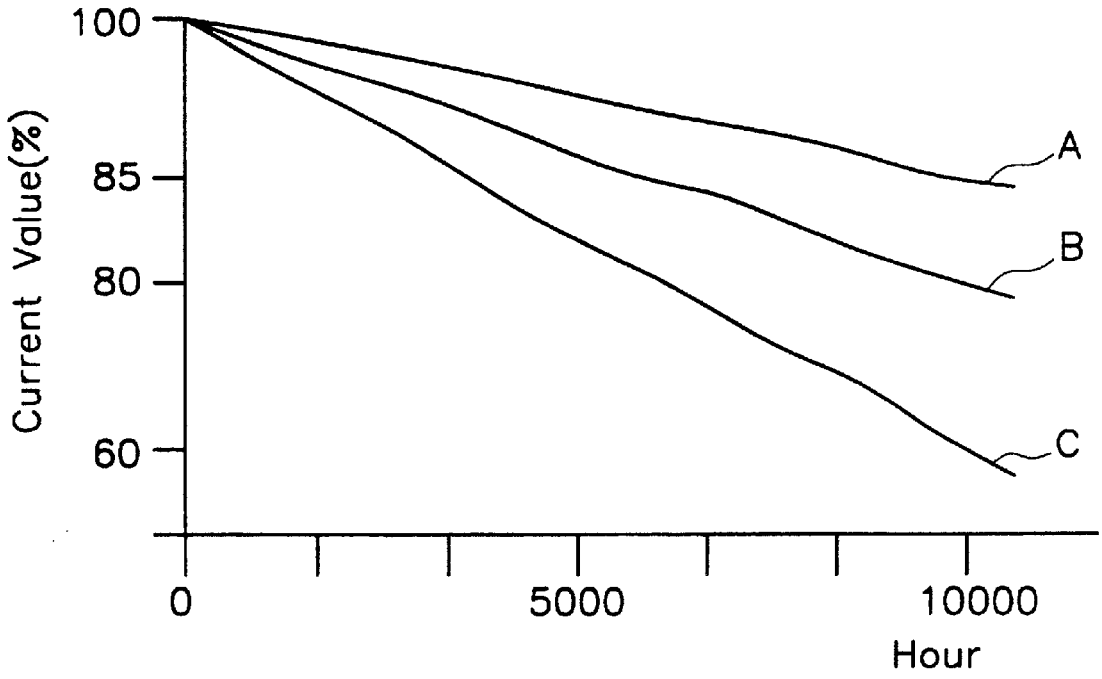
FIG. 3 is a diagram showing a life cycle characteristic of a cathode for an electron gun in accordance with the present invention.

FIG. 3 shows a result of testing a life cycle characteristic of the cathode for the electron gun according to the first and the second embodiments.

In FIG. 3, the graph A shows the life cycle of the cathode according to the second embodiment comprising the upper metal layer 62 and the electron emitting layer 80 composed of carbonate containing 0.5 wt% of La—Mg compound.

The graph B shows the life cycle of the cathode according to the first embodiment comprising the upper metal layer 62 and the electron emitting layer 80 composed of carbonate, and the graph C shows the life cycle of the conventional oxide cathode comprising the electron emitting layer 80 composed of carbonate only.

The test of life cycle is performed by measuring the decreasing amount of the electron emitting current during continuous operation for 10,000 hours.

At this moment, 2,000~3,000 $\mu$A of current is applied to each cathode.

As shown in FIG. 3, the cathode for the electron gun according to the first and the second embodiments are considerably improved in its life cycle in high current in comparison with C according to the conventional art.

Using the cathode according to the present invention, 80~85% of first current value is maintained after operating for 10,000 hours in high current density.

Figure 4:
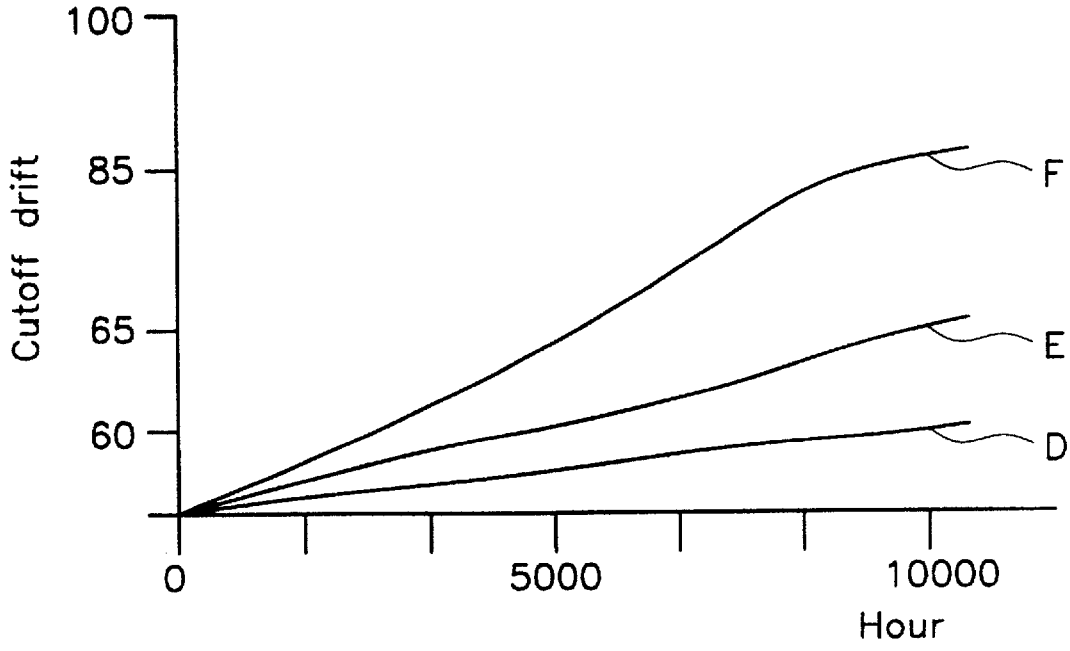
FIG. 4 is a diagram showing a cutoff drift of a cathode for an electron gun in accordance with the present invention.
Figure 5:
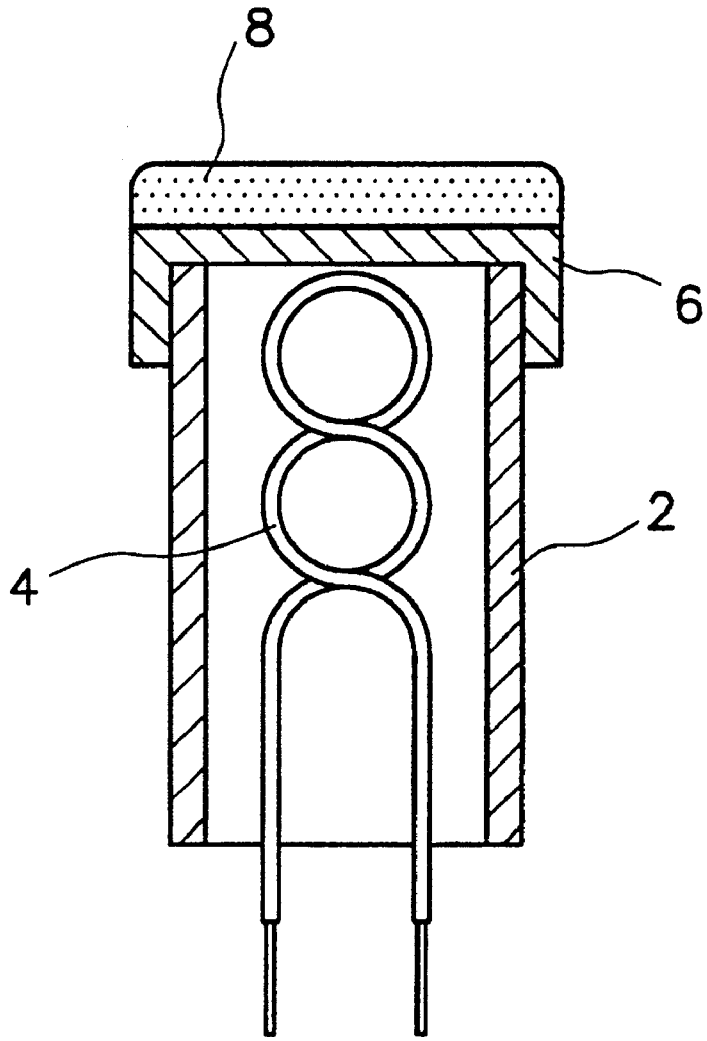
FIG. 5 is a sectional view of a conventional cathode for an electron gun.
Figure 6:
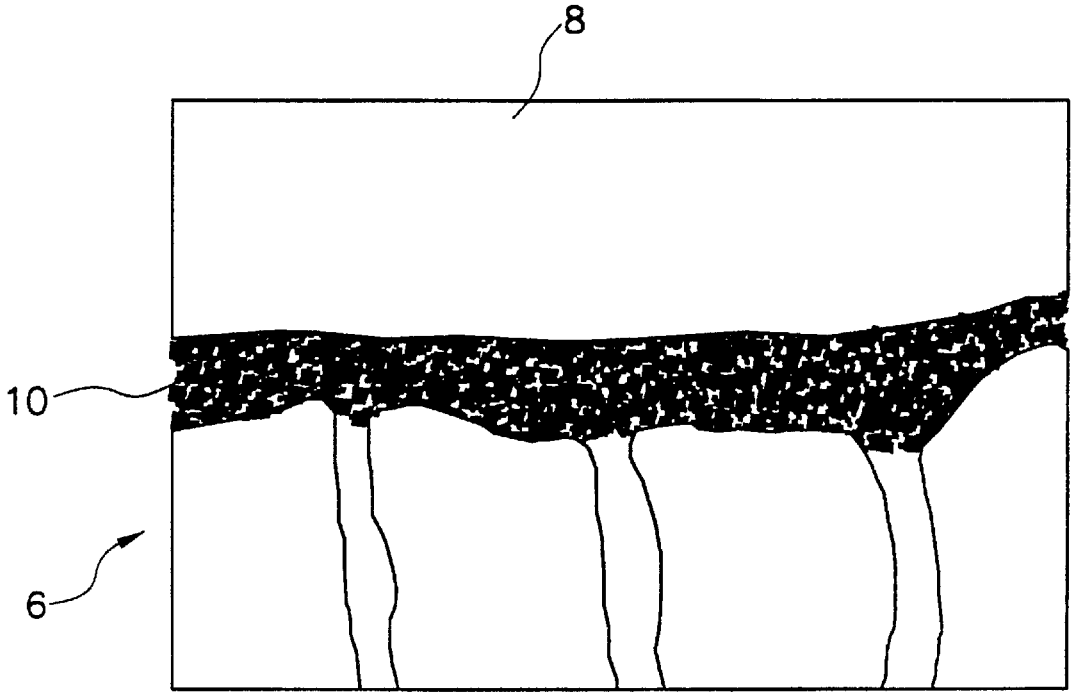
FIG. 6 is an enlarged sectional view of a conventional cathode.

FIG. 4 is a diagram showing a cutoff drift characteristic of the cathode for an electron gun in accordance with the present invention.

In FIG. 4, the graph D shows the cutoff drift of the cathode according to the second embodiment comprising the upper metal layer 62 and the electron emitting layer 80 composed of carbonate containing 0.5wt% of La—Mg compound.

The graph E shows the cutoff drift of the cathode according to the first embodiment comprising the upper metal layer 62 and the electron emitting layer 80 composed of carbonate, and the graph F shows the cutoff drift of the conventional oxide cathode comprising the electron emitting layer 80 composed of carbonate only.

The test of cutoff drift characteristic is performed by measuring the changing amount of the cutoff drift during continuous operation for 10,000 hours.

The test of the cathode of the present invention shows 20~25% of decrease in comparison with the cutoff drift of the conventional oxide cathode F.

According to the present invention, since the upper metal layer having fine-grain formed between the base metal containing the reducing component and the electron emitting layer composed of carbonate disperses the material generated by the reaction of BaO and Si or Mg and ensures the diffusion path of the reducing component, free radical Ba can be continuously emitted.

In addition, since the inventive cathode comprises the electron emitting layer containing both of La compound and Mg compound or La—Mg mixed compound, the evaporation of free radical Ba atom can be restrained.

As described above, since free radical Ba is continuously emitted and restrained to be evaporated due to the interaction of the upper metal layer and the electron emitting layer, the life cycle is improved even under high current density load of 2~3 A/cm$^2$.

In addition, the inventive cathode can be manufactured easily and at low price in comparison with the conventional impregnated cathode (I-cathode).

It will be apparent to those skilled in the art that various modifications and variations can be made in the cathode for the electron gun of the present invention without departing from the spirit or scope of the invention.

Thus, it is intended that the present invention cover the modifications and variations of this invention provided they come within the scope of the appended claims and their equivalents.

What is claimed is:

1. A method for manufacturing a cathode for an electron gun, the method comprising the steps of:

(a) forming a base metal including nickel and at least one kind of reducing element;

(b) forming an upper metal layer by finely graining and by heating an upper surface of the base metal; and (c) forming an electron emitting material layer on an upper surface of the upper metal layer, the electron emitting material layer including an alkaline earth metal oxide, the alkaline earth metal oxide including at least barium.

2. The method according to claim 1, wherein step (b) includes the step of forming the upper metal layer by implanting Ni-atoms in the upper surface of the base metal and heating to within a temperature range of 700–1200° C. in a hydrogenous condition.

3. The method according to claim 1, wherein step (b) includes the step of forming the upper metal layer by grinding the upper surface of the base metal and heating to within a temperature range of 700–1200° C. in a hydrogenous condition.

4. The method according to claim 1, wherein step (b) includes the step of forming the upper metal layer by accelerating powder of the alkaline earth metal oxide, colliding the powder with the upper surface of the base metal and heating to within a temperature range of 700–1200° C. in a hydrogenous condition.

5. The method according to claim 4, wherein the step of heating includes the step of heating at a different temperature in at least one step.

6. The method according to claim 1, wherein the electron emitting material layer further includes a lanthanum compound, a magnesium compound or a lanthanum-magnesium mixed compound.

* * * * *